United States Patent [19]

Dato et al.

[11] Patent Number: 4,562,645

[45] Date of Patent: Jan. 7, 1986

[54] RAZOR CARTRIDGE AND METHOD OF MANUFACTURE

[75] Inventors: Anthony L. Dato, Madison; Carl A. Hultman, Derby, both of Conn.

[73] Assignee: Warner-Lambert Company, Morris Plains, N.J.

[21] Appl. No.: 654,422

[22] Filed: Sep. 26, 1984

[51] Int. Cl.[4] ..... B26B 21/14

[52] U.S. Cl. ..... 30/346.58; 30/47; 76/104 R; 76/DIG. 8

[58] Field of Search ..... 30/346.58, 346.59, 47, 30/77, 50; 76/DIG. 8, 104 R

[56] References Cited

U.S. PATENT DOCUMENTS 2,550,056 4/1951 Foltis ..... 30/47

4,354,312 10/1982 Trotta ..... 30/47

*Primary Examiner*—James M. Meister

*Attorney, Agent, or Firm*—R. S. Strickler

[57] ABSTRACT

A plastic cartridge body having an elongated slot for receiving a U-shaped blade having two cutting edges where the blade is fabricated in continuous chain-like fashion, shaped, separated into individual blades, and inserted into the body slot.

10 Claims, 7 Drawing Figures

RAZOR CARTRIDGE AND METHOD OF MANUFACTURE

BACKGROUND OF THE INVENTION

This invention relates to razors and relates in particular to the head or cartridge portion of a razor.

The cartridge may have a handle formed integrally therewith or be formed with a track or channel engageable with a mating handle in well-known fashion.

Presently there is great commercial activity directed toward manufacture and sale of high-quality low-cost razors or razor cartridges referred to in the trade as "disposables".

In this application, the language "razor", "razor cartridge" or "cartridge" is intended to refer to the shaving head.

Therefore, the present invention is directed to a novel cartridge structure and a novel method of manufacture.

A prior art razor and/or cartridge structure over which the present invention is an improvement is disclosed and described in U.S. Pat. No. 4,354,312 issued to R. A. Trotta on Oct. 19, 1982, and assigned on the face of the patent to The Gillette Company.

SUMMARY OF THE INVENTION

A razor cartridge embracing certain features of the present invention may comprise a molded, one-piece plastic body having an elongated opening bounded by a first surface defining a first blade support, a second surface defining a second blade support, a rear wall formed with at least one through opening, and a one-piece blade element having two cutting edges in frictional engagement with said supports, said blade element having an opening falling into register with said wall opening.

A method of fabricating the razor of the present invention may comprise the steps of forming a blade chain having opposed cutting edges, separating the chain into links each defining a single blade having opposed cutting edges, providing a molded plastic blade support having an elongated slot and at least two face-engaging surfaces, forming the blade into a generally U-shaped configuration so that the cutting edges are spaced from and generally parallel to one another, and positioning the shaped blade in the slot so that the cutting edges cooperate with the face-engaging surfaces to develop an operative razor cartridge.

Other features and advantages of the present invention will become apparent from an examination of the succeeding specification when read in conjunction with the apended drawings, in which;

DESCRIPTION OF PREFERRED EMBODIMENT

Figure 1:
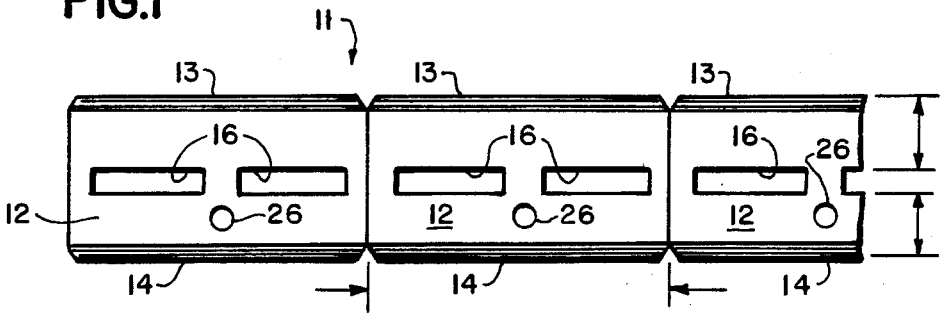
FIG. 1 is a schematic view of a blade chain.
Figure 2:
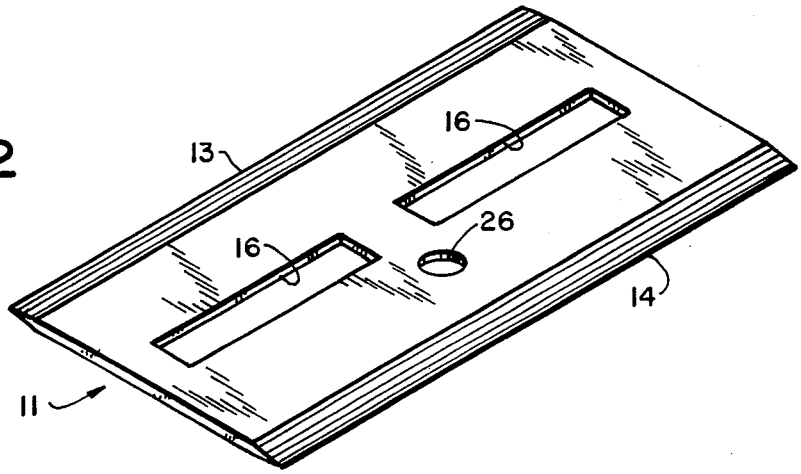
FIG. 2 shows a chain link defining a blade having opposed cutting edges.

Referring to the drawings, the reference numeral 11 designates a chain composed of links defining blades 12—12 each having opposed cutting edges 13-14.

The blades are formed with one or more openings 16 which cooperate with mating openings in a razor body to facilitate purging shaving debris in a manner which will become more apparent hereinafter.

Figure 6:
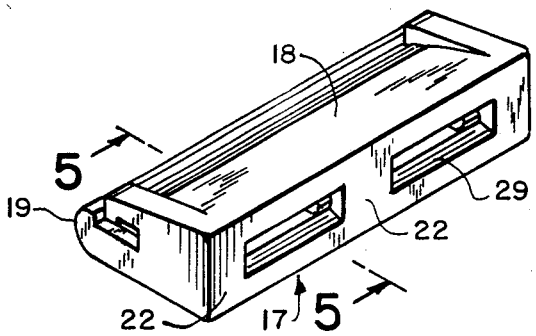
FIG. 6 is a rear perspective showing debris-purging openings.

A plastic cartridge body indicated generally by the reference numeral 17 (FIG. 6) includes a cap or first face-engaging surface 18, a guard bar or second face-engaging surface 19, elongated slot 21, and a rear wall 22.

Figure 3:
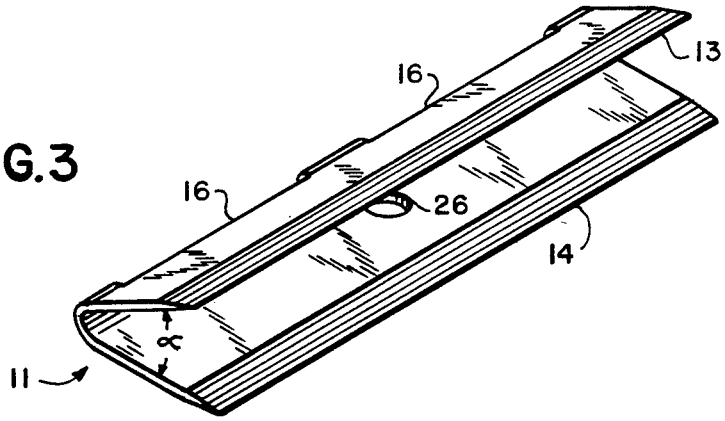
FIG. 3 shows the step of forming the blade into a U-shaped configuration.

The blade 12 is shaped into a generally U-shaped configuration as shown in FIG. 3 so that angle alpha $\alpha$ creates a span between parallel and offset cutting edges 13 and 14.

Figure 4:
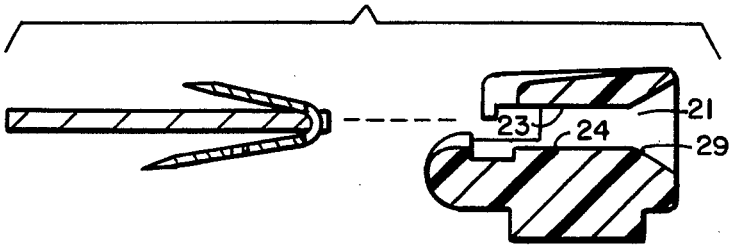
FIG. 4 shows a slotted plastic cartridge body and the step of inserting the shaped blade.

The angle alpha $\alpha$ is selected relative to the cross-sectional configuration of the slot 21 so that when the shaped blade is loaded into the cartridge body (see FIG. 4) the blade is held under compressive stress by first and second blade supports 23 and 24 creating friction between each blade and the blade support.

Figure 5:
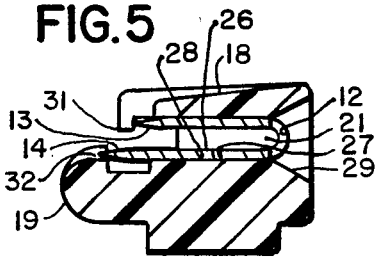
FIG. 5 is a vertical section in the plane of line 5—5 in FIG. 6 and shows the blade in place in the body.

To position the blade accurately to develop appropriate blade geometry, a notch 26 in the blade engages a mating protuberance 27 as the blade slides along incline 28 and ultimately snaps into position as shown in FIG. 5.

Note that the rear wall 22 of the cartridge body is formed with openings 29—29 which mate with blade openings 16—16 to facilitate purging shaving debris.

Figure 7:
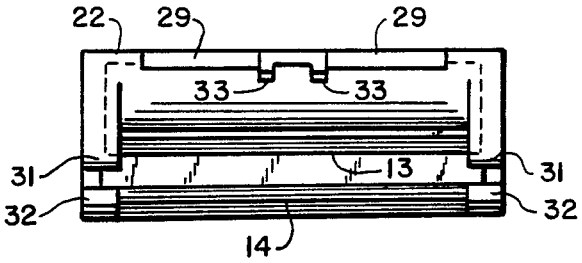
FIG. 7 shows a top view of a completed cartridge.

To enhance the proper position of the blade and to insure its retention within the body of the cartridge, the cap or first face-engaging surface is formed with spaced shoulders or stops 31—31 which engage mating portions of the adjacent blade edge as is apparent in FIGS. 5 and 7.

Correspondingly and for further insurance of proper placement and retention of the blade, the guard bar 19 is formed with a spaced pair of stops 32—32 engaging mating portions of the blade edge 14 as shown in FIG. 5.

An alternative alignment structure is shown in FIG. 7 wherein a pair of locator pins 33—33 molded integrally with rear wall 22 engage adjacent blade openings 16—16.

The method of the present invention is practiced by generating an endless chain of blades ground, honed and stropped to develop opposed cutting edges in well-known fashion.

Next the chain is separated into links where each link defines a double-edged blade.

The blade is formed into a U or U-shape so that the blade subtends a desired angle alpha $\alpha$.

Alternatively the U-shape can be formed before separating the chain into blade links as manufacturing and machine design considerations dictate.

A one-piece plastic body is molded with an elongated slot 21, face-engaging surfaces 18 and 19, openings and protuberances as desired.

The shaped blade is pressed into the slot so that the blade supports are in frictional engagement with the blade and the blade element is under a compressive stress.

Various notches, stops and locating pins are utilized as necessary to fix and retain the blade element in an appropriate relationship relative to both face-engaging surfaces to generate optimum blade geometry for wet shaving.

It is anticipated that a wide variety of modifications and design changes may be developed without departing from the spirit and scope of method and apparatus of the present invention.

What is claimed is:

1. A razor cartridge defining a molded, one-piece plastic body having an elongated opening bounded by a first surface defining a first blade support, a second surface defining a second blade support, a rear wall formed with at least one through opening, and a one-piece blade element having two cutting edges in frictional engagement with said supports, said blade element having an opening falling into register with said wall opening.

2. The cartridge of claim 1 in which one of the blade elements and a blade support is formed with a protuberance mating with a cooperating notch formed in the other of said blade elements and blade support for locating the blade element relative to said blade supports.

3. The cartridge of claim 1 in which one of the blade elements and the rear wall is formed with a protuberance mating with a notch formed in the other of said elements and said wall.

4. The cartridge of claim 2 or 3 in which one of said blade supports terminates in a pair of opposed, spaced shoulders engageable with spaced portions of said blade element for retaining the blade element within said body.

5. The cartridge of claim 2 or 3 in which both blade supports terminate in a pair of opposed, spaced shoulders engageable with spaced portions of each cutting edge.

6. The cartridge of claim 1 in which the body includes a guard bar and a cap.

7. A method of fabricating a low cost razor cartridge comprising the steps of:

forming a blade chain having opposed cutting edges, separating the chain into links each defining a single blade having opposed cutting edges, providing a molded plastic blade support having an elongated slot and at least two face-engaging surfaces, forming the blade into a generally U-shaped configuration so that the cutting edges are spaced from and generally parallel to one another, and positioning the shaped blade in the slot so that the cutting edges cooperate with the face-engaging surfaces to develop an operative razor cartridge.

8. The method of claim 7 plus the step of selecting a span between cutting edges such that the blade is under a compressive stress in said slot.

9. The method of claim 8 plus the step of locking the U-shaped blade in said slot.

10. The method of claim 7 in which forming the U-shaped configuration occurs after forming the blade chain and before separating the chain into links.

* * * * *